US012741229B2

(12) United States Patent
Malavolti

(10) Patent No.: US 12,741,229 B2
(45) Date of Patent: Sep. 22, 2026

(54) FOG DISTRIBUTION SYSTEMS AND METHODS

(71) Applicant: Joshua Malavolti, Morton, IL (US)

(72) Inventor: Joshua Malavolti, Morton, IL (US)

( * ) Notice: Subject to any disclaimer, the term of this patent is extended or adjusted under 35 U.S.C. 154(b) by 136 days.

(21) Appl. No.: 18/413,401

(22) Filed: Jan. 16, 2024

(65) Prior Publication Data

US 2024/0238691 A1 Jul. 18, 2024

Related U.S. Application Data

(60) Provisional application No. 63/480,012, filed on Jan. 15, 2023.

(51) Int. Cl.
*A63J 5/02* (2006.01)

(52) U.S. Cl.
CPC ..... *A63J 5/025* (2013.01)

(58) Field of Classification Search
CPC ..... A63J 5/025
See application file for complete search history.

(56) References Cited

U.S. PATENT DOCUMENTS 3,244,641 A * 4/1966 Strittmatter ..... B05B 7/0012 239/77
4,836,452 A * 6/1989 Fox ..... B05B 7/0012 239/338
4,871,115 A 10/1989 Hessey
4,990,290 A * 2/1991 Gill ..... A63J 5/025 55/482
5,240,648 A * 8/1993 Gill ..... B01F 23/21 417/372
6,168,531 B1 1/2001 Adamson et al.
6,400,897 B1 * 6/2002 Lin ..... F04B 9/14 392/405
7,434,418 B2 * 10/2008 Schock ..... F41H 9/08 62/387
7,963,507 B2 * 6/2011 Scully ..... B05B 7/0012 261/119.1
10,981,079 B1 * 4/2021 Goepfert ..... A63J 5/025
11,154,791 B2 * 10/2021 Tomazetich ..... B05B 7/0483
11,628,377 B2 * 4/2023 Pogue ..... A63H 33/28 472/65
12,433,964 B2 * 10/2025 Kim ..... A61L 2/084
(Continued)

FOREIGN PATENT DOCUMENTS

DE 10022381 A1 * 7/2001 ..... F41H 9/06
DE 10022381 C2 * 11/2002 ..... F41H 9/06
(Continued)

*Primary Examiner* — Craig Kim
(74) *Attorney, Agent, or Firm* — Hartman Global IP Law; Gary M. Hartman; Domenica N.S. Hartman

(57) ABSTRACT

Fog distribution systems including a fog generation device configured to produce fog. The systems include an output fluidly connected to a collection chamber that captures and accumulates the fog. The collection chamber includes a bottom wall, a first sidewall, a second sidewall, a top wall, and a diverter. The diverter creates a channel between a first space and a second space defined by the diverter within the collection chamber. The collection chamber includes an outlet with a mechanical blower configured to draw the fog from inside the collection chamber through a distribution tube for distribution of the fog to a desired location.

20 Claims, 5 Drawing Sheets

(56) References Cited

U.S. PATENT DOCUMENTS

| | | | | |
|---|---|---|---|---|
| 2003/0202785 | A1* | 10/2003 | Monitto | A63J 5/025 392/405 |
| 2011/0215166 | A1* | 9/2011 | Rosario | A01K 37/00 119/713 |
| 2015/0105167 | A1* | 4/2015 | Kim | A63H 33/22 472/57 |
| 2017/0128825 | A1* | 5/2017 | Wu | A63H 30/04 |
| 2018/0221785 | A1* | 8/2018 | Tomazetich | B01F 23/21 |
| 2019/0321744 | A1* | 10/2019 | Xu | A63J 5/025 |
| 2020/0398177 | A1* | 12/2020 | Peeples | A63H 33/28 |
| 2021/0162312 | A1* | 6/2021 | Tomazetich | B05B 7/1686 |
| 2023/0149957 | A1* | 5/2023 | Ziemkowski | A63J 5/025 239/13 |
| 2024/0238691 | A1* | 7/2024 | Malavolti | A63J 5/025 |

FOREIGN PATENT DOCUMENTS

| | | | | | |
|---|---|---|---|---|---|
| DE | 10249329 | A1 * | 5/2003 | A63J 5/025 |
| EP | 0158038 | B1 * | 6/1988 | B01F 23/21 |
| EP | 1321825 | A2 * | 6/2003 | G03G 9/1135 |
| GB | 2306887 | A * | 5/1997 | B01F 25/25 |
| KR | 100204921 | B1 * | 6/1999 | A63J 5/025 |
| WO | WO-9725122 | A1 * | 7/1997 | A63J 5/025 |
| WO | WO-2011063369 | A2 * | 5/2011 | A01M 7/0014 |
| WO | WO-2020190937 | A1 * | 9/2020 | A63J 5/025 |
| WO | WO-2022055505 | A1 * | 3/2022 | A63J 5/025 |

* cited by examiner

FOG DISTRIBUTION SYSTEMS AND METHODS

CROSS-REFERENCE TO RELATED APPLICATIONS

This application claims the benefit of U.S. Provisional Application No. 63/480,012 filed Jan. 15, 2023, the contents of which are incorporated herein by reference.

BACKGROUND OF THE INVENTION

The invention relates generally to systems and methods of producing a manmade or "synthetic" fog used for entertainment purposes, and more particularly to systems and methods capable of enhancing the delivery and distribution of such a fog to desired locations.

Fog machines used for entertainment purposes are typically stand-alone systems that produce a manmade or synthetic fog that is then immediately and directly delivered to the atmosphere or open air environment. In these machines, a fog is generated by vaporizing a fluid with a heating element as the fluid flows through the machine, such that the fog exits the machine at a relatively high temperature that causes the fog to be disperse or thin (i.e., not particularly dense) and rise in the air. Further, once the fog exits the machine it is subject to atmospheric conditions including air or wind currents, making it difficult to direct a dense fog to a particular location, especially if the intent is to create a dense low-lying fog, e g., on a stage, at or near the ground, etc. Fog machines therefore must be placed at or in very close proximity to the location where the fog is desired, which can necessitate the use of multiple fog machines to obtain the desired coverage. Additionally, the fluid being vaporized in a fog machine tends to sufficiently cool its heating element to cause the machine to pause while reheating the element. Fog machines also exhibit a deficiency in heat cycling because time is required for a machine to be sufficiently reheated to generate fog, further necessitating the need for multiple machines in a single location.

In view of the above, it would be desirable if an improved system and method were available for generating a dense simulated fog from a central location and distributing that fog to one or more specific remotely desired locations.

BRIEF SUMMARY OF THE INVENTION

The intent of this section of the specification is to briefly indicate the nature and substance of the invention, as opposed to an exhaustive statement of all subject matter and aspects of the invention. Therefore, while this section identifies subject matter recited in the claims, additional subject matter and aspects relating to the invention are set forth in other sections of the specification, particularly the detailed description, as well as any drawings.

The present invention provides, but is not limited to, fog distribution systems and methods of distributing fog generated by a fog distribution system.

According to a nonlimiting aspect of the invention, a fog distribution system includes a fog generation device configured to produce a fog from a fluid. The fog distribution system further includes a collection chamber having an enclosed interior cavity configured to receive, capture, and accumulate the fog produced by the fog generation device. The collection chamber includes a bottom wall, a first sidewall, a second sidewall, and a top wall. A diverter is disposed within the collection chamber to define a first space within the enclosed interior cavity, a larger second space within the enclosed interior cavity, and a channel between that fluidically interconnects the first and second spaces and is located at an upper end of the diverter. An outlet of the collection chamber is fluidly connected to the second space of the collection chamber, and a mechanical blower is configured to draw the fog from the second space of the collection chamber and flow the fog through a distribution tube for distribution of the fog to a desired location.

According to another nonlimiting aspect of the invention, a method of distributing a fog includes generating a fog in a fog generation device, directing the fog through an output of the fog generation device and into a first space within a collection chamber, causing the fog to flow from the first space upward and then through a channel into a second space within the collection chamber wherein the first space, the second space, and the channel are defined by a diverter, temporarily accumulating the fog within the second space of the collection chamber. And operating a mechanical blower to draw the fog from the second space, through an outlet in the collection chamber, and to a first remote location.

Technical aspects of systems and methods having features as described above preferably include the ability to capture and accumulate the fog and then distribute the fog at a continuous flow while increasing the density of the fog and reducing heat cycling.

These and other aspects, arrangements, features, and/or technical effects will become apparent upon detailed inspection of the figures and the following detailed description.

DETAILED DESCRIPTION OF THE INVENTION

Figure 1:
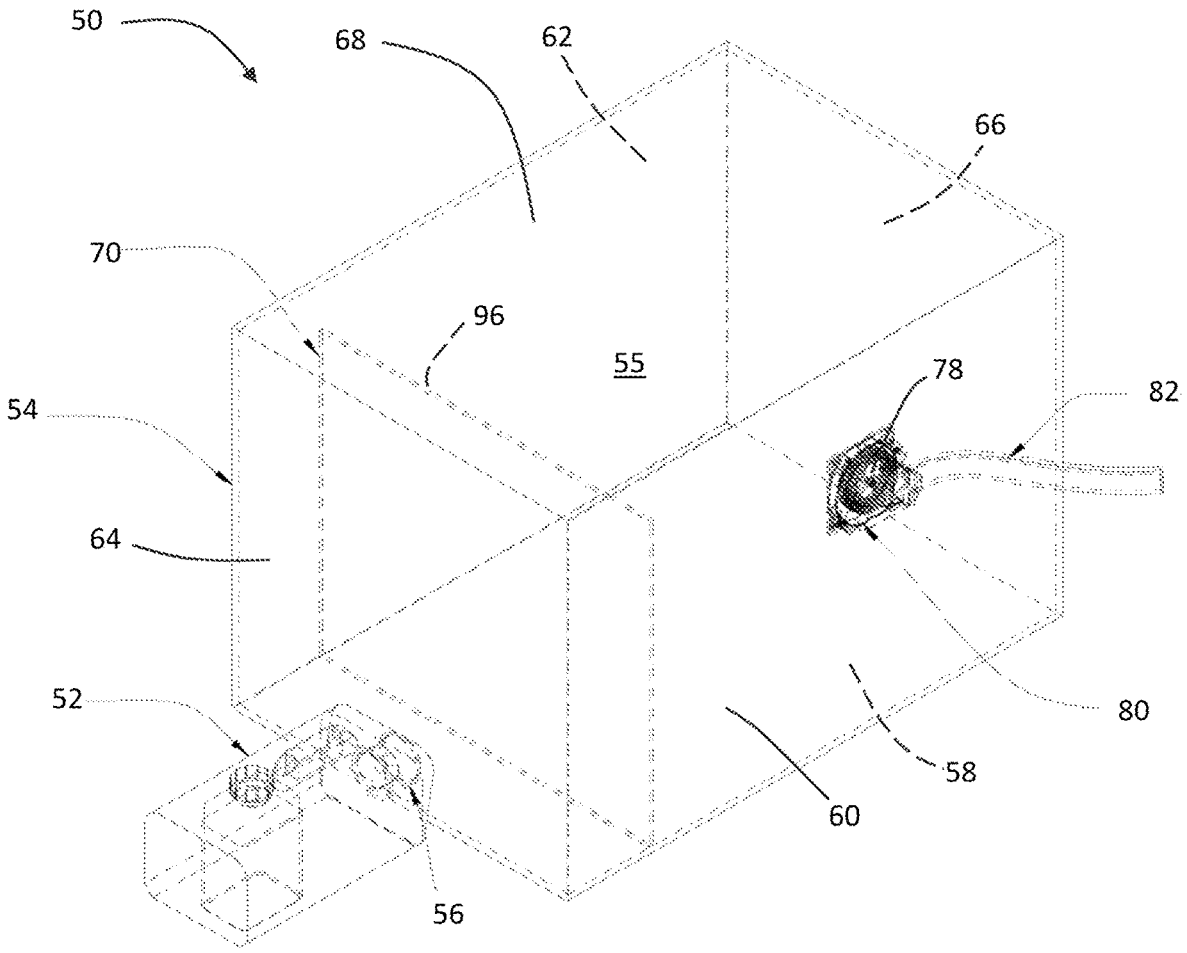
FIG. 1 schematically represents a perspective view of a fog distribution system of the present invention.

The intended purpose of the following detailed description of the invention and the phraseology and terminology employed therein is to describe one or more nonlimiting embodiments of the invention, and to describe certain but not all aspects of the embodiment(s). The following detailed description also identifies certain but not all alternatives of the embodiment(s). As nonlimiting examples, the invention encompasses additional or alternative embodiments in which one or more features or aspects shown and described as part of a particular embodiment could be eliminated, and also encompasses additional or alternative embodiments that combine two or more features or aspects shown and described as part of different embodiments. Therefore, the appended claims, and not the detailed description, are intended to particularly point out subject matter regarded to be aspects of the invention, including certain but not necessarily all of the aspects and alternatives described in the detailed description.

The following disclosure describes various aspects of nonlimiting embodiments of fog distribution systems 50 that are represented in FIGS. 1 through 5. For convenience, consistent reference numbers are used throughout FIGS. 1 through 5 to identify the same or functionally related/equivalent elements of the various embodiments of the fog distribution systems 50 represented in the drawings. To facilitate the description provided below of the embodiment(s) represented in the drawings, relative terms, including but not limited to, "proximal," "distal," "anterior," "posterior," "vertical," "horizontal," "lateral," "front," "rear," "side," "forward," "rearward," "top," "bottom," "upper," "lower," "above," "below," "right," "left," etc., may be used in reference to the orientation of the lathing strip during its use and/or as represented in the drawings. All such relative terms are useful to describe the illustrated embodiment(s) but should not be otherwise interpreted as limiting the scope of the invention.

Figure 2:
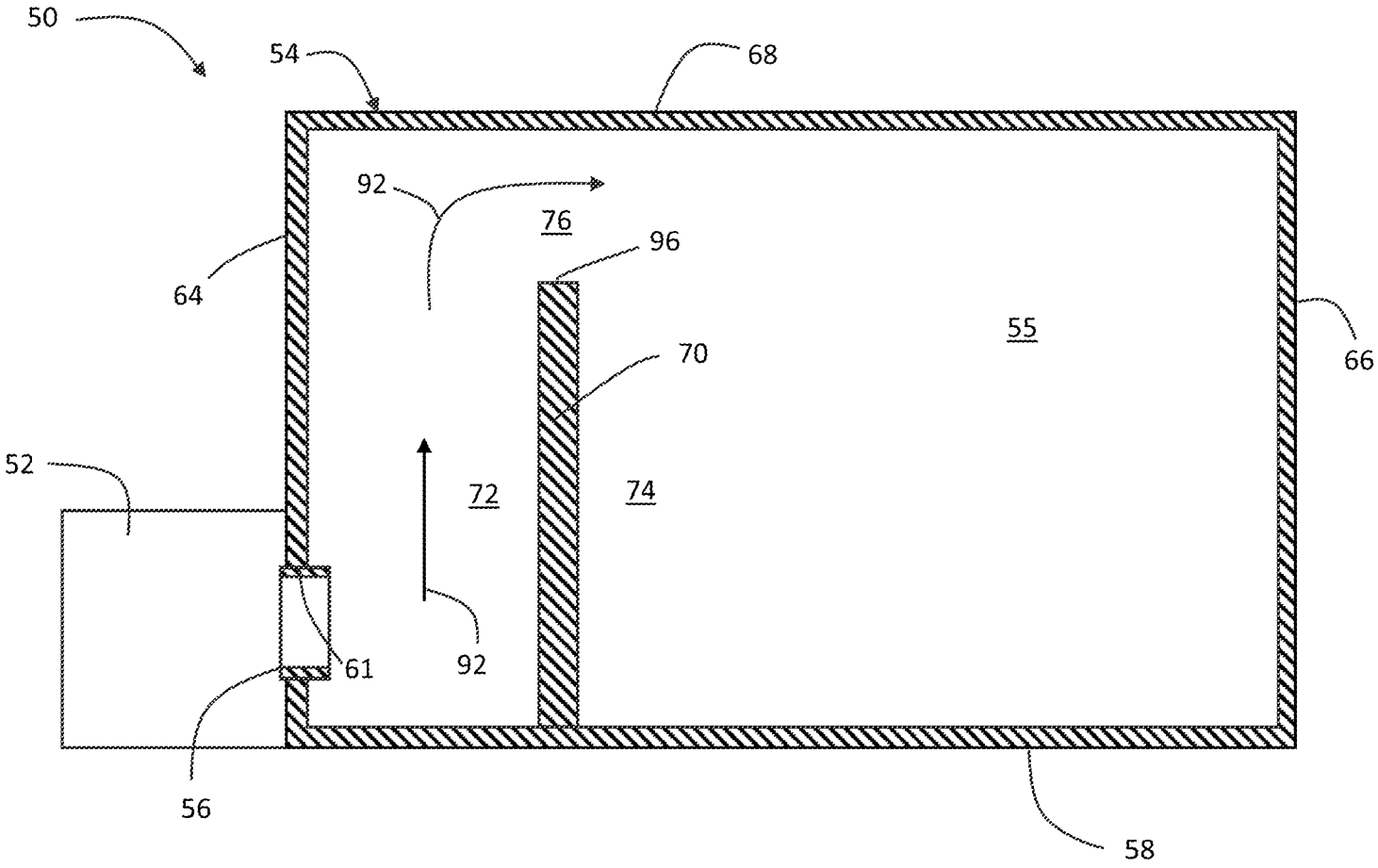
FIG. 2 schematically represents a sectioned side view of the fog distribution system of FIG. 1.

FIGS. 1 and 2 schematically represent a fog distribution system 50 according to a nonlimiting first embodiment of the present invention. The fog distribution system 50 generally includes a fog generation device 52 and a collection chamber 54. The fog generation device 52 includes an output 56 that is fluidly connected to the collection chamber 54 and through which a fog generated by the device 52 exits the device 52 and enters an enclosed interior cavity 55 of the collection chamber 54. The fog generation device 52 may be a known type of device or machine configured to generate synthetic fog, so long as the fog generation device 52 is part of a sealed system with the collection chamber 54. Examples of fog generation devices and machines that are currently available include products such as the Titan series offered Froggy's Fog, the Z series offered by Antari Lighting & Effects LTD., and the Hurricane series offered by ADJ Products, LLC. Machines of these types produce a fog by vaporizing a fluid with a heating element as the fluid flows through the machine, such that the fog exits the machine at a relatively high temperature. The fluid may be a water-based solution that contains an amount of glycol and/or glycerin that, when vaporized, creates a desired fog and/or smoke effect. Such solutions are well known and will not be discussed in any detail here. Though a single fog generation device 52 is represented as coupled to the collection chamber 54, it is foreseeable that more than one fog generation device could be used.

The collection chamber 54 includes a bottom wall 58, a first sidewall 60, a second sidewall 62 oppositely disposed from the first sidewall 60, and a top wall 68 oppositely disposed from the bottom wall 58. The chamber 54 is additional represented as including a third sidewall 64 and a fourth sidewall 66 oppositely disposed from the third sidewall 60. In combination, the bottom wall 58, sidewalls 60, 62, 64, and 66, and top wall 68 define the enclosed interior cavity 55 of the collection chamber 54 that is configured to receive and accumulate the fog received from the fog generation device 52. The collection chamber 54 may be constructed from any solid materials that are impervious to gases and resistant to corrosion, for example, plastics, composites, and/or corrosion-resistant metals. A through-opening 61 (FIG. 2) is defined in the third sidewall 64 to receive the output 56 of the fog generation device 52. The output 56 conducts the fog from the fog generation device 52 directly at a diverter 70 within the collection chamber 54 that, in FIGS. 1 and 2, is represented as a solid wall that is within the cavity 55 of the collection chamber 54 and is preferably impervious to gases. The diverter 70 of FIGS. 1 and 2 extends from the first sidewall 60 to the second sidewall 62 and from the bottom wall 58 towards the top wall 68 of the collection chamber 54. The diverter 70 preferably contacts and is contiguous with the bottom wall 58 and the first and second sidewalls 60 and 62 to define first and second spaces 72 and 74 (FIG. 2) within the enclosed interior cavity 55 of the collection chamber 54. The diverter 70 preferably forms fluid-tight seals with the bottom wall 58 and the first and second sidewalls 60 and 62, but preferably does not form a fluid-tight seal with the top wall 68 and instead defines a channel 76 between the top wall 68 and an upper end 96 of the diverter 70 that fluidically interconnects the first and second spaces 72 and 74 adjacent the top wall 68. Though the channel 76 is represented as continuous and extending the entirety of the distance between the first and second sidewalls 60 and 62, it is foreseeable that the channel 76 could extend a limited portion or limited portions of this distance as a result of segments of the diverter 70 contacting the top wall 68. The diverter 70 is configured to disrupt the flow path of fog from the fog generation device 52 as it enters the collection chamber 54, in that fog entering the collection chamber 54 through the output 56 of the fog generation device 52 (serving as the inlet to the collection chamber 54) does not have a direct path to an outlet 78 of the collection chamber 54 that is fluidly connected to the second space 74 of the collection chamber 54, but instead encounters the diverter 70 disposed between the output 56 and the outlet 78. The diverter 70 forces the fog to flow upward toward the top wall 68 where the fog is then redirected over the diverter 70 and into the second space 74 via the channel 76, generally defining a flow path 92 as represented by arrows in FIG. 2.

The second space 74 is significantly larger than the first space 72, e.g., a volume of preferably at least about three times as large as the first space 72, enabling the second space 74 to serve as an accumulator that temporarily retains the fog within the collection chamber 54 before the fog exits the collection chamber 54 through the outlet 78, represented in FIG. 2 as disposed in the first sidewall 60. A mechanical blower 80 is shown as mounted or otherwise coupled to the outlet 78, and a distribution tube 82 is fluidly connected with the mechanical blower 80. Together, the mechanical blower 80 and distribution tube 82 are configured to draw fog that has accumulated within the second space 74 of the collection chamber 54 and distribute the fog to a remote desired location. The mechanical blower 80 may be any device that is capable of causing the supply of fog to flow out of the collection chamber 54, as nonlimiting examples, a centrifugal blower, bilge fan, or axial fan. Furthermore, the mechanical blower 80 can be replaced by or supplemented with a remote blowing device (e.g., a fan) located within the distribution tube 82 that draws the fog from the collection chamber 54 and optionally provides a desired distribution effect. The operation of the mechanical blower 80 can be controlled to correlate the flow through the tube 82 with the rate at which the fog is supplied by the fog generation device 52, the volumes of the collection chamber 54 and its first and second spaces 72 and 74, etc.

Figure 3:
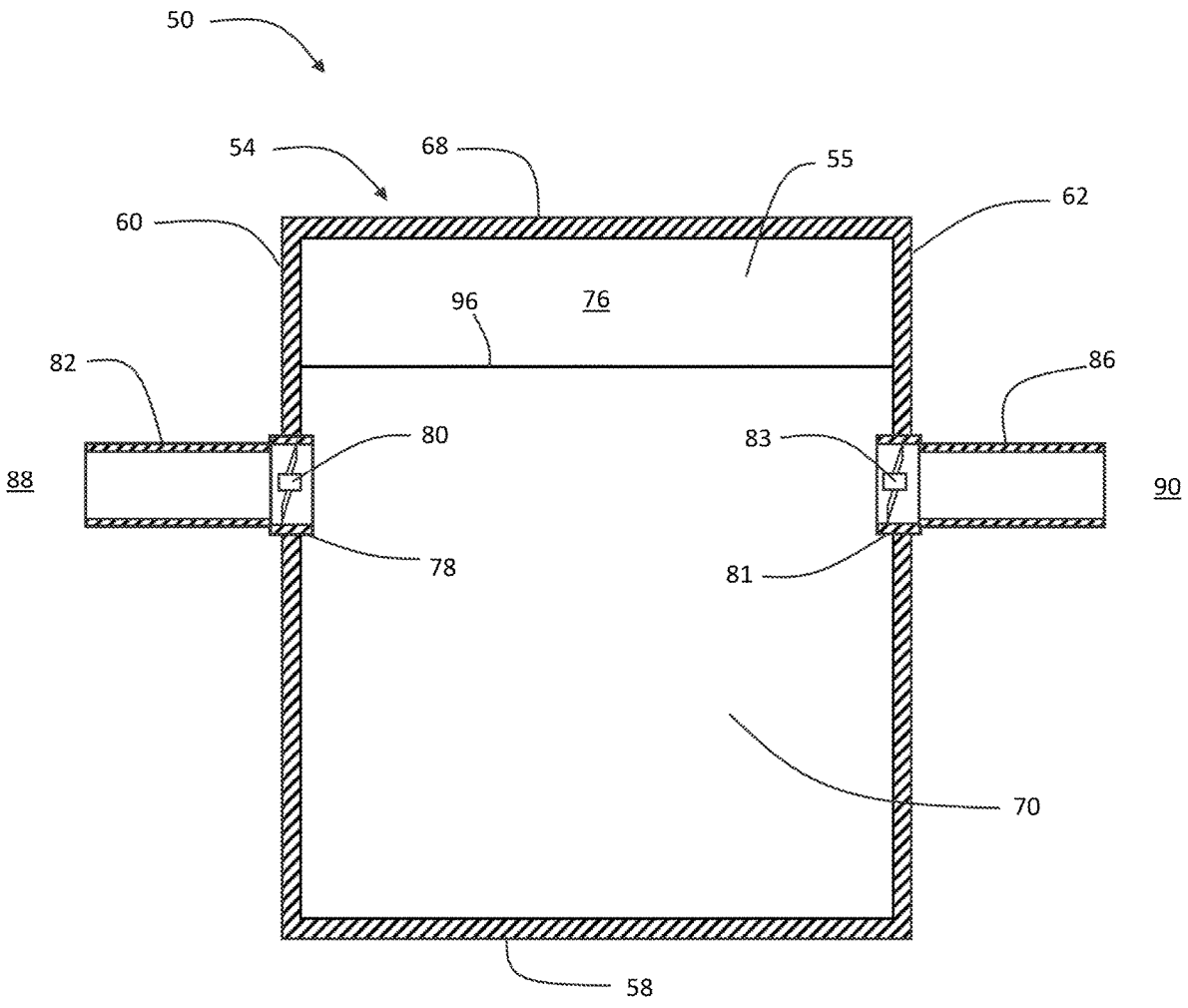
FIG. 3 schematically represents a sectioned end view of another embodiment of a fog distribution system.
Figure 4:
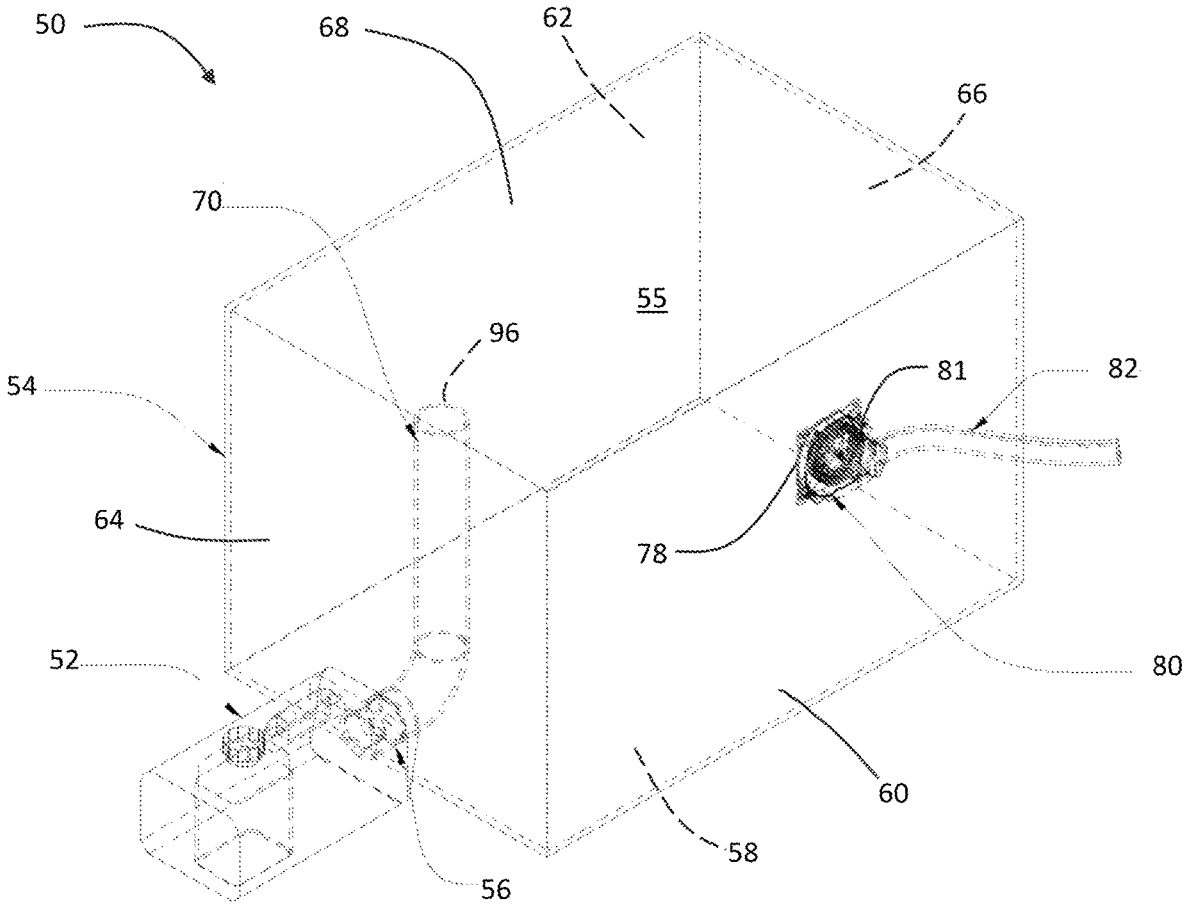
FIG. 4 schematically represents a perspective view of yet another embodiment of the fog distribution system of FIG. 1.
Figure 5:
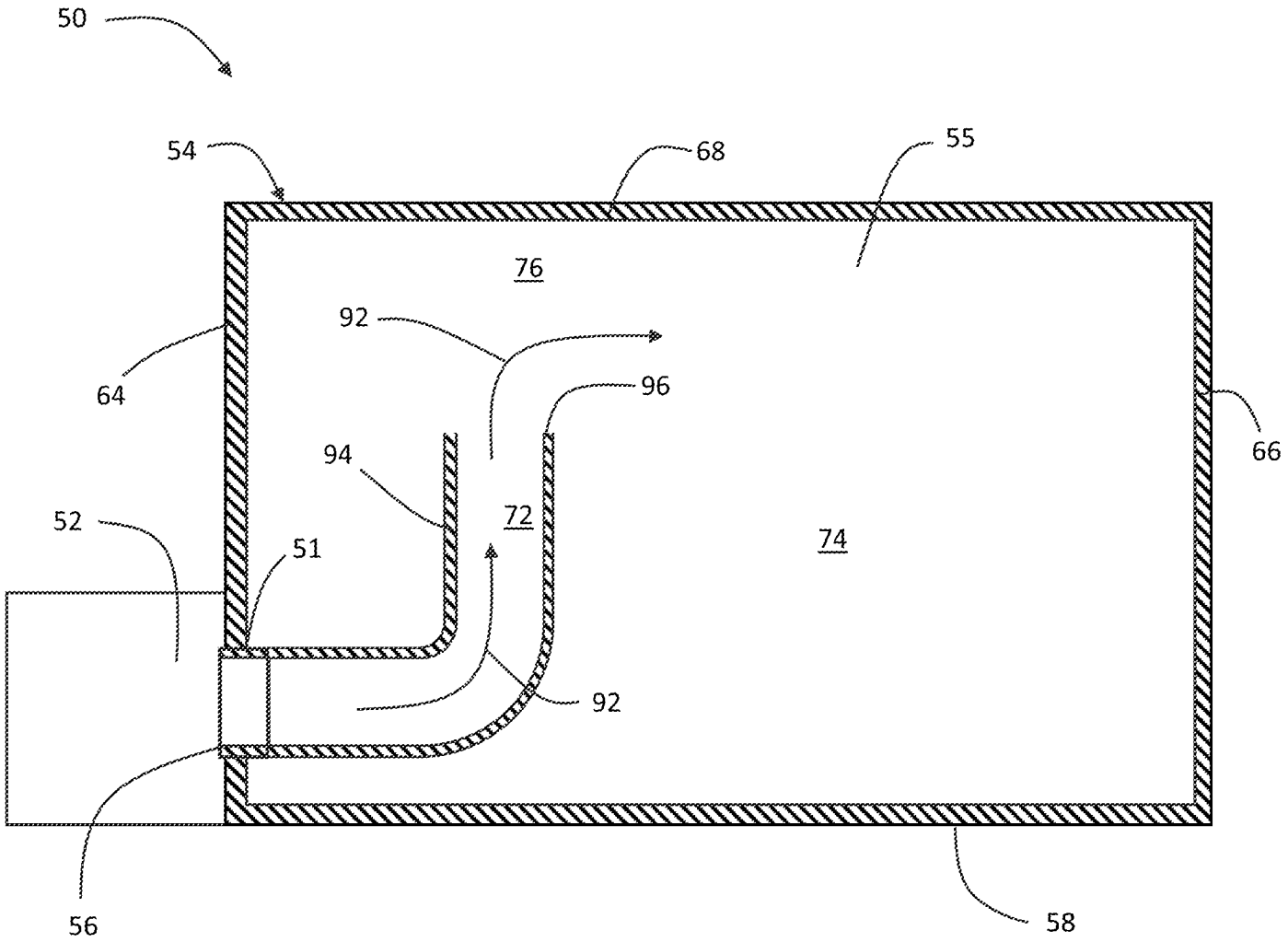
FIG. 5 schematically represents a sectioned side view of the fog distribution system of FIG. 4.

FIGS. 3 through 5 depict additional configurations of the fog distribution system 50 and its collection chamber 54 in accordance with further embodiments of this invention. In the drawings, consistent reference numbers are used to identify the same or functionally equivalent elements. In view of similarities between the embodiments, the following discussion of FIGS. 3 through 5 will focus primarily on aspects of the further embodiments that differ from the first embodiment of FIGS. 1 and 2 in some notable or significant manner. Other aspects of the further embodiments not discussed in any detail can be, in terms of structure, function, materials, etc., essentially as was described for the first embodiment.

FIG. 3 schematically represents the fog distribution system 50 as equipped with a multi-blower system, including the mechanical blower 80 and associated distribution tube 82 of FIGS. 1 and 2 mounted to the first sidewall 60 and fluidically connected through the outlet 78 to the second space 74 of the collection chamber 54, as well as a second mechanical blower 83 and associated second distribution tube 86 mounted to the second sidewall 62 and fluidically connected through a second outlet 81 of the collection chamber 54 to the second space 74. The mechanical blower 80 is connected to the distribution tube 82 for distribution of the fog to a first remote location 88, whereas the second mechanical blower 83 is connected to the second distribution tube 86 for distribution of the fog to a second remote location 90. The first and second mechanical blowers 80 and 83 can be synchronously or independently controlled to regulate the amount of fog delivered to the remote locations 88 and 90.

The fog distribution system 50 of FIGS. 4 and 5 is represented as equipped with a diverter 70 comprising a tube 94 whose walls are preferably solid and impervious to gases. An internal passage within the tube 94 is fluidly connected with the output 56 of the fog generation device 52. From the output 56, the tube 94 initially extends into the enclosed interior cavity 55 of the collection chamber 54 in a horizontal direction. The tube 94 includes a bend (preferably 90 degrees) that causes the tube 94 to extend vertically toward the top wall 68 of the collection chamber 54. The tube 94 defines a flow path 92 along which fog generated by the fog generation device 52 exits the tube 94 at the upper end 96 thereof in proximity to the top wall 68, such that the fog is directed toward the top wall 68 before entering the collection chamber 54. The tube 94 effectively defines the first space 72 of the collection chamber 54, a space between the top wall 68 and the upper end 96 of the tube 92 defines the channel 76, and the remainder of the collection chamber 54 defines the second space 76. In the embodiment of FIGS. 4 and 5, the second space 74 is significantly larger than the first space 72, e.g., a volume of preferably at least about fifty times as large as the first space 72, enabling the second space 74 to serve as a larger accumulator that temporarily retains the fog within the collection chamber 54 before the fog exits the collection chamber 54 through the outlet 78, represented in FIG. 4 as disposed in the first sidewall 60.

The fog distribution systems 50 represented in FIGS. 1 through 5 are configured to facilitate a method in which fog generated at one location can be dispensed at a remote location or multiple remote locations and in a continuous manner. A supply of fog is generated in the fog generation device 52 and directed through the output 56 and into the first space 72 of the collection chamber 54. As the fog enters the first space 72, the fog initially encounters the diverter 70 and, as a result, fills the first space 72 until the fog reaches the upper end 96 of the diverter 70. The fog flows through the channel 76, spilling over the upper end 96 of the diverter 70 and into the larger second space 74 of the collection chamber 54, where the fog temporarily accumulates. As the fog enters the first space 72, the velocity of the fog decreases and the fog begins to cool and become denser. While or after flowing through the channel 76, the velocity of the fog is further decreased as it accumulates within the second space 74, allowing the fog to further cool and become denser. This cooling effect can be achieved without the need for supplemental hydration or cooling (e.g., with ice or a refrigerant), and is desirable for creating a low-lying fog when dispensed from the distribution tube(s) 82 and/or 86. The supply of fog may be allowed to accumulate within the first and second spaces 72 and 74 of the collection chamber 54 before the operation of the mechanical blower(s) 80 and/or 83 begins. The ability to store the supply of fog within the collection chamber 54 allows for a continuous supply of fog to be dispensed to one or more desired locations. Once the operation of the one or more mechanical blower(s) 80 and/or 83 begins, the blower(s) 80 and/or 83 draw(s) the fog within the collection chamber 54 and cause(s) the fog to flow through the distribution tube(s) 82 and/or 86 to the desired location (s) 88 and/or 90. As the supply of fog is pulled through the distribution tube(s) 82 and/or 86, its temperature is further decreased.

Once the fog exits the distribution tube(s) 82 and/or 86, the fog is preferably low-lying and achieves a blanketing effect that is capable of evenly covering a large surface area. This appearance of the fog is desirable for entertainment purposes, including but not limited to concerts, stage performances, Halloween displays, cinema, and other entertainment venues. Further, the fog distribution system is applicable to both indoor and outdoor applications.

As previously noted above, though the foregoing detailed description describes certain aspects of one or more particular embodiments of the invention, alternatives could be adopted by one skilled in the art. For example, the fog distribution systems 50 and their components could differ in appearance and construction from the embodiments described herein and shown in the drawings, functions of certain components of the fog distribution systems 50 could be performed by components of different construction but capable of a similar (though not necessarily equivalent) function, and appropriate materials could be substituted for those noted. As such, and again as was previously noted, it should be understood that the invention is not necessarily limited to any particular embodiment described herein or illustrated in the drawings.

The invention claimed is:

1. A fog distribution system comprising a fog generation device configured to produce a fog from a fluid, the fog distribution system further comprising:

a collection chamber having an enclosed interior cavity configured to receive, capture, and accumulate the fog produced by the fog generation device, the collection chamber including a bottom wall, a first sidewall, a second sidewall, and a top wall;

a diverter within the collection chamber, the diverter defining a first space within the enclosed interior cavity of the collection chamber, a larger second space within the enclosed interior cavity, and a channel between and fluidically interconnecting the first and second spaces, the channel being located at an upper end of the diverter;

a through-opening that receives the fog of the fog generation device and conducts the fog from the fog generation device into the first space and directly at the diverter;

an outlet of the collection chamber fluidly connected to the second space of the collection chamber;

a mechanical blower configured to draw the fog from the second space of the collection chamber and flow the fog through a distribution tube for distribution of the fog to a desired location; and a flow path defined within the collection chamber by the diverter and in which the fog produced by the fog generation device enters the first space through the through-opening at a velocity, the velocity of the fog is decreased within the first space, the fog is redirected over the diverter into the second space via the channel, and the second space is sufficiently larger than the first space so that the velocity of the fog is further decreased within the second space and the fog produced by the fog generation device accumulates within the second space before being drawn from the second space by the mechanical blower.

2. The fog distribution system of claim 1, further comprising a second outlet of the collection chamber including a second mechanical blower configured to draw the fog from the second space of the collection chamber and flow the fog through a second distribution tube for distribution of the fog to a second desired location.

3. The fog distribution system of claim 1, wherein the diverter comprises a wall extending from the first sidewall to the second sidewall and extending from the bottom wall towards the top wall to create the channel between the top wall and the upper end of the diverter.

4. The fog distribution system of claim 3, wherein the wall forms fluid-tight seals with the bottom wall, the first sidewall, and the second sidewall.

5. The fog distribution system of claim 1, wherein the second space has a volume of at least about three times as large as the first space.

6. The fog distribution system of claim 3, wherein the wall is a solid gas-impervious wall.

7. A fog distribution system, comprising a fog generation device configured to produce a fog from a fluid, the fog distribution system further comprising:

a collection chamber having an enclosed interior cavity configured to receive, capture, and accumulate the fog produced by the fog generation device, the collection chamber including a bottom wall, a first sidewall, a second sidewall, and a top wall;

a diverter within the collection chamber, the diverter defining a first space within the enclosed interior cavity of the collection chamber, a larger second space within the enclosed interior cavity, and a channel between and fluidically interconnecting the first and second spaces, the channel being located at an upper end of the diverter;

an outlet of the collection chamber fluidly connected to the second space of the collection chamber; and a mechanical blower configured to draw the fog from the second space of the collection chamber and flow the fog through a distribution tube for distribution of the fog to a desired location;

wherein the diverter comprises a tube that extends horizontally into the enclosed interior cavity and then extends vertically upward toward the top wall to create the channel between the top wall and the upper end of the diverter.

8. The fog distribution system of claim 7, wherein the tube has a solid gas-impervious wall.

9. A method of distributing fog, the method comprising:

generating a fog in a fog generation device;

directing the fog through an output of the fog generation device and into a first space within a collection chamber, the fog entering the first space through a through-opening of the collection chamber that receives the fog of the fog generation device and conducts the fog from the fog generation device into the first space and directly at a diverter;

causing the fog to flow on a flow path from the first space upward and then through a channel into a second space within the collection chamber, flow path, the first space, the second space, and the channel being defined by the diverter, the fog produced by the fog generation device entering the first space through the through-opening at a velocity, the velocity of the fog decreasing within the first space, and the fog being redirected over the diverter into the second space via the channel;

temporarily accumulating the fog within the second space of the collection chamber, the second space being sufficiently larger than the first space so that the velocity of the fog is further decreased within the second space and the fog accumulates within the second space; and operating a mechanical blower to draw the fog from the second space, through an outlet in the collection chamber, and to a first remote location.

10. The method of claim 9, wherein the fog that accumulates within the second space consists of the fog produced by the fog generation device.

11. The method of claim 9, wherein the fog has a temperature that decreases while flowing from the output of the fog generation device to the first space within the collection chamber and while flowing through the channel to the second space within the collection chamber.

12. The method of claim 9, wherein the fog becomes denser while flowing from the output of the fog generation device to the first space within the collection chamber and while flowing through the channel to the second space within the collection chamber.

13. The method of claim 9, wherein a second outlet of the collection chamber includes a second mechanical blower configured to draw the fog from the second space of the collection chamber and flow the fog through a second distribution tube for distribution of the fog to a second desired location.

14. The method of claim 9, wherein the diverter comprises a wall extending from the first sidewall to the second sidewall and extending from the bottom wall towards the top wall to create the channel between the top wall and the upper end of the diverter.

15. The method of claim 14, wherein the wall forms fluid-tight seals with the bottom wall, the first sidewall, and the second sidewall.

16. The method of claim 9, wherein the second space has a volume of at least about three times as large as the first space.

17. The method of claim 14, wherein the wall is a solid gas-impervious wall.

18. A method of distributing fog, the method comprising:

generating a fog in a fog generation device;

directing the fog through an output of the fog generation device and into a first space within a collection chamber;

causing the fog to flow from the first space upward and then through a channel into a second space within the collection chamber, the first space, the second space, and the channel being defined by a diverter;

temporarily accumulating the fog within the second space of the collection chamber; and operating a mechanical blower to draw the fog from the second space, through an outlet in the collection chamber, and to a first remote location;

wherein the diverter comprises a tube that extends horizontally into the enclosed interior cavity and then extends vertically upward toward the top wall to create the channel between the top wall and the upper end of the diverter.

19. The method of claim 18, wherein the tube has a solid gas-impervious wall.

20. The method of claim 18, wherein the collection chamber receives the fog produced by the fog generation device through an output of the fog generation device that conducts the fog directly into the tube.

* * * * *